US010150649B2

(12) United States Patent
Webb et al.

(10) Patent No.: US 10,150,649 B2
(45) Date of Patent: Dec. 11, 2018

(54) OVERWIND CONVEYANCE DROP PROTECTION

(71) Applicant: Technological Resources Pty. Limited, Brisbane (AU)

(72) Inventors: Rocky Lynn Webb, North Bay (CA); Fredric Christopher Delabbio, Samford (AU)

(73) Assignee: Technological Resources Pty. Limited, Melbourne (AU)

( * ) Notice: Subject to any disclaimer, the term of this patent is extended or adjusted under 35 U.S.C. 154(b) by 76 days.

(21) Appl. No.: 14/895,754

(22) PCT Filed: Jun. 6, 2014

(86) PCT No.: PCT/AU2014/000597
§ 371 (c)(1),
(2) Date: Dec. 3, 2015

(87) PCT Pub. No.: WO2014/194373
PCT Pub. Date: Dec. 11, 2014

(65) Prior Publication Data

US 2016/0122160 A1 May 5, 2016

(30) Foreign Application Priority Data

Jun. 7, 2013 (AU) ..... 2013902058

(51) Int. Cl.
*B66B 17/02* (2006.01)
*B66B 17/08* (2006.01)
(Continued)

(52) U.S. Cl.
CPC ..... *B66B 17/02* (2013.01); *B66B 5/02* (2013.01); *B66B 5/08* (2013.01); *B66B 5/26* (2013.01);
(Continued)

(58) Field of Classification Search
CPC .... B66B 5/10; B66B 5/26; B66B 5/28; B66B 17/02; B66B 17/08; B66B 17/34
See application file for complete search history.

(56) References Cited

U.S. PATENT DOCUMENTS 607,450 A * 7/1898 Musnicki ..... B66B 5/08 187/349
642,448 A * 1/1900 Holmes ..... B66B 5/26 187/356
(Continued)

FOREIGN PATENT DOCUMENTS

CN 2255971 Y 6/1997
CN 2550333 Y 5/2003
(Continued)

OTHER PUBLICATIONS

Nov. 30, 2016—(CN) Office Action—App 201480032385.8.
(Continued)

*Primary Examiner* — Minh Truong
(74) *Attorney, Agent, or Firm* — Banner & Witcoff, Ltd.

(57) ABSTRACT

A hoist system for hoisting a conveyance from a mineshaft, comprising: a head frame mounted over the mineshaft; a hoist connected to the conveyance by an elongate flexible hoisting element so as to be operable to hoist the conveyance from the mineshaft by winding the hoisting element; an upper crash barrier located on the head frame so as to be engageable by the conveyance to prevent upward movement of the conveyance beyond the crash barrier in an overwind condition; and an upper conveyance retarder to retard upward movement of the conveyance as it approaches the crash barrier.

20 Claims, 9 Drawing Sheets

(51) Int. Cl.

| | |
|---|---|
| ***B66B 5/28*** | (2006.01) |
| ***E21F 13/00*** | (2006.01) |
| ***B66B 5/08*** | (2006.01) |
| ***B66B 5/02*** | (2006.01) |
| ***B66B 5/26*** | (2006.01) |
| ***E21D 1/00*** | (2006.01) |

(52) U.S. Cl.
CPC ..... *B66B 5/28* (2013.01); *B66B 17/08* (2013.01); *E21D 1/00* (2013.01); *E21F 13/00* (2013.01)

(56) References Cited

U.S. PATENT DOCUMENTS

| | | | | | |
|---|---|---|---|---|---|
| 762,612 | A * | 6/1904 | Bending | B66B 5/28 | 187/340 |
| 787,258 | A * | 4/1905 | Austin | B66B 5/28 | 187/343 |
| 818,523 | A * | 4/1906 | Dahlin | B66B 5/08 | 187/349 |
| 969,557 | A * | 9/1910 | Norris | B66B 17/34 | 187/338 |
| 1,068,105 | A * | 7/1913 | Carman | B66B 5/26 | 187/378 |
| 1,209,361 | A * | 12/1916 | Lonielli | B66B 5/28 | 187/343 |
| RE14,864 | E * | 5/1920 | Boggio | B66B 5/08 | 187/349 |
| 1,368,103 | A * | 2/1921 | Boggio | B66B 5/08 | 187/349 |
| 1,562,117 | A * | 11/1925 | Monroe | B66B 5/18 | 187/356 |
| 1,594,317 | A * | 7/1926 | Moore | B66B 5/28 | 187/344 |
| 2,503,954 | A * | 4/1950 | Lindahl | B66B 17/34 | 187/357 |
| 4,015,689 | A * | 4/1977 | Johnson | B66B 5/10 | 187/277 |
| 4,444,293 | A | 4/1984 | Paul et al. | | |
| 6,736,242 | B2 * | 5/2004 | Nygren | B66B 5/005 | 187/302 |
| 7,413,060 | B2 * | 8/2008 | Takashi | B66B 5/0075 | 187/351 |
| 2006/0201744 | A1 * | 9/2006 | Curtis | A62B 1/22 | 182/138 |

FOREIGN PATENT DOCUMENTS

| | | | |
|---|---|---|---|
| CN | 2570232 | Y | 9/2003 |
| CN | 2654579 | Y | 11/2004 |
| GB | 478220 | A | 1/1938 |
| GB | 1454129 | A | 10/1976 |
| GB | 2019811 | | 11/1979 |
| JP | 2007-254054 | A | 10/2007 |
| SU | 16377 | | 8/1930 |
| SU | 92549 | A1 | 11/1950 |
| SU | 742327 | A1 | 6/1980 |
| WO | 2011/000037 | A1 | 1/2011 |
| ZA | 2003/4258 | | 4/2004 |

OTHER PUBLICATIONS

Jul. 31, 2014—(WO) International Search Report and Written Opinion for PCT/AU2014/000597.
Apr. 10, 2018—(RU)—Office Action—App 2015152499.

* cited by examiner 27
22
17
24

11
14
20
12
15
30
32
17
16
18
19
21

16

OVERWIND CONVEYANCE DROP PROTECTION

CROSS-REFERENCE TO RELATED APPLICATIONS

The present application is a U.S. National Phase filing of International Application No. PCT/AU2014/000597, filed on Jun. 6, 2014, designating the United States of America and claiming priority to Australian Patent Application No. 2013902058 filed Jun. 7, 2013, and the present application claims priority to and the benefit of both the above-identified applications, which are incorporated by reference herein in their entireties.

TECHNICAL FIELD

The present disclosure relates to hoist systems for hoisting mineshaft conveyances. Such conveyances can be used for conveying mine personnel or equipment or for raising excavated material from a mineshaft, which material may be excavated during shaft sinking operations or during subsequent mining activities.

BACKGROUND

Traditional shaft sinking operations are carried out by drilling and blasting below a work stage, to excavate material from a hole, and removing the excavated material using a mucking system by which the excavated material is picked up and deposited in buckets or kibbles that are hoisted to the surface. More recently there have been proposals to increase the speed at which sinking can progress by using earth boring machinery. International patent publication number WO 2011/000037A1 discloses such a proposal for sinking a mineshaft in which earth excavated by a boring machine is transferred into large capacity conveyances in the form of skips or buckets that are raised and lowered by a hoisting system installed at the mine surface or at the top of a winze. On completion of shaft sinking operations the hoisting system and skips may subsequently be operated to convey material excavated during production mining.

As mentioned above, traditional shaft sinking uses buckets or kibbles in place of skips. This is because buckets and kibbles are open-topped to facilitate mucking, and to fulfil shaft bottom access requirements (e.g. where personnel are transported in the buckets). Once the buckets or kibbles descend below the work stage, they are unguided—in other words, the buckets or kibbles can rotate and swing laterally. Unguided movement is borne out of necessity, since any guides below the work stage would be blasted away by the next blasting operation at the bottom of the mineshaft.

Since the buckets or kibbles are able to rotate, they are generally round. The round shape ensures consistent accessibility for mucking, regardless of the orientation of the buckets or kibbles when they reach the bottom of the mineshaft. Moreover, buckets and kibbles are open-topped so that they are consistently open and available for loading, regardless of orientation. In contrast, skips generally have an enclosed top and load through an opening in the upper side, meaning they can generally only be loaded from a particular direction. Skips also generally discharge through the bottom, which is a discharge process that is incompatible with conventional shaft mucking and unloading equipment. Skips typically have a square cross-section and therefore cannot travel below the work stage for mucking since it is difficult to control the skips to ensure they are oriented correctly for mucking. Lastly, while buckets and kibble are detachable to allow multiple buckets or kibbles to be concurrently position on the bottom of the shaft, skips are permanently attached to the hoist rope. Skips are therefore not appropriate for use in blasting and mucking operations.

In all cases where a conveyance travels up a shaft, above personnel or crews, it is desirable that the conveyance be brought to a halt, in the event that it experiences any uncontrolled movement. Some systems for responding to uncontrolled movements provide hoist motor controls that cease hoisting the conveyance when, for example, an overwind event occurs (i.e. the conveyance travels past its discharge position in the head frame). However, ceasing to hoist the conveyance does not necessarily prevent against subsequent freefall of the conveyance, particularly in the case that the hoist rope breaks.

Although the system of the present disclosure has arisen from the desire to provide safeguards when hoisting heavily loaded skip conveyances, particularly where those conveyances travel above crews (e.g. are suspended loads above personnel), it may be applied to the hoisting of any mineshaft conveyance where protection against uncontrolled movements of conveyances in desirable.

The term "skip" refers inter alia to a conveyance used to bring mined material to the surface of a mine shaft. Skips are manufactured in various sizes and designs for both vertical and incline shafts, including closed-topper tip over models and bottom door dump models Skips are distinct from "buckets" insofar as:

a) skips are self dumping (whether tip over i.e. from top or bottom);

b) skips are utilised in production shafts (not in construction/sinking);

c) skips are permanently attached to the hoist rope; and d) skips do not have to be able to stand on the bottom of a mineshaft (i.e. can be extremely long and slender)

A "bucket" and "kibble" are each a cylindrical shaped conveyance, use to transport blasted muck from the shaft bottom, during sinking operations.

When compared with skips, buckets:

a) require manual dumping b) must be unloaded in a tip over fashion c) are attached to the hoist rope via detachable hook to suspension chains (or bale) at the top of the bucket (minimum of 3 to maintain stability)

d) must be used in conjunction with a crosshead to provide guidance in the shaft barrel e) are unguided below shaft guide system or work stage f) must be used with only low spin or lock coil hoisting ropes g) are regularly removed from the hoist rope (generally to load at shaft bottom) during the loading operation h) must be round and have a height to diameter ratio that is stable and will stand unsupported on shaft bottom.

Unless context specifies otherwise, the term "guide" as used herein refers to a member along which a conveyance travels down a mineshaft, and that resists or prevents rotation of the conveyance and lateral movements of the conveyance relative to the mineshaft. Such a "guide" provides no motive or drive force to cause movement of the conveyance.

SUMMARY OF THE PRESENT DISCLOSURE

The present disclosure provides a hoist system for hoisting a conveyance from a mineshaft, comprising:

a head frame mounted over the mineshaft;

a hoist connected to the conveyance by an elongate flexible hoisting element so as to be operable to hoist the conveyance from the mineshaft by winding the hoisting element;

an upper crash barrier located on the head frame so as to be engageable by the conveyance to prevent upward movement of the conveyance beyond the crash barrier in an overwind condition; and an upper conveyance retarder to retard upward movement of the conveyance as it approaches the crash barrier.

When a conveyance experiences an overwind condition, it may impact the head frame, sheave or crash beam, and rebound. An 'overwind condition' is where the conveyance overshoots the uppermost position the conveyance is intended to reach, during upward travel. Typically, the uppermost position is a discharge location at which the conveyance discharges its load.

The upper conveyance retarder may at least partially absorb the rebound energy of the conveyance. The rebound energy is the energy passed from the conveyance into the head frame, sheave or crash beam, that is subsequently transferred back into the conveyance to push it downward (i.e. 'bounce' energy).

The hoist system may further comprise a conveyance catcher to catch the conveyance from free fall downward movement in the event that the conveyance engages the upper crash barrier and the hoisting element fails.

The hoist system may further comprise a lower conveyance retarder located below the upper conveyance retarder and the conveyance catcher, the lower conveyance retarder for retarding free fall of the conveyance in the event that the conveyance catcher fails to catch the free falling conveyance.

The lower conveyance retarder may absorb the remaining energy that has not beforehand been absorbed by the upper conveyance retarder.

The hoist system may further comprise a lower crash barrier having an open condition in which to allow upward and downward movements of the conveyance from and into the mineshaft. The lower crash barrier may be releasable upon upward movement of the conveyance toward or into engagement with the upper crash barrier, to a closed condition to prevent downward movement of the conveyance into the mineshaft in the event that the lower conveyance retarder fails to stop a free fall of the conveyance.

The lower crash barrier may have an open condition in which to allow upward and downward movements of a conveyance from and into the mineshaft, and a closed condition to prevent debris from falling into the mineshaft.

The lower crash barrier may comprise one or more crash doors.

The lower crash barrier may comprise one door that closes beneath the conveyance in an overwind event.

The lower crash barrier may comprise two doors that close together beneath the conveyance in an overwind event.

The system of the present disclosure may also provide a hoist system for hoisting a conveyance from a mineshaft, comprising:

a head frame mounted over the mineshaft;

a hoist connected to the conveyance by an elongate flexible hoisting element so as to be operable to hoist the conveyance from the mineshaft by winding the hoisting element;

an upper crash barrier located on the head frame so as to be engageable by the conveyance to prevent upward movement of the conveyance beyond the crash barrier; and a conveyance catcher to catch the conveyance from free fall downward movement in the event that the conveyance engages the upper crash barrier and the hoisting element fails.

The hoist system may further comprise an upper conveyance retarder to retard upward movement of the conveyance as it approaches the crash barrier, and a lower conveyance retarder located below the upper conveyance retarder and the conveyance catcher, the lower conveyance retarder for retarding free fall of the conveyance in the event that the conveyance catcher fails to catch the free falling conveyance.

The hoist system may further comprise a lower crash barrier having an open condition in which to allow upward and downward movements of the conveyance from and into the mineshaft but releasable upon upward movement of the conveyance toward or into engagement with the upper crash barrier to a closed condition to prevent downward movement of the conveyance into the mineshaft.

The hoist system may further comprise a crash barrier releaser actuated by upward movement of the conveyance to release the lower crash barrier to its closed condition.

The releaser may be actuated by upward movement of the conveyance prior to its engagement with the upper crash barrier.

The releaser may be actuated with activation of the upper conveyance retarder to retard upward movement of the conveyance.

The conveyance catcher may be a jack catcher.

The jack catcher may comprise pivoting jack catches on the headframe engageable with lugs on the conveyance to catch the conveyance against downward movement.

The upper conveyance retarder may be an energy absorption device. More specifically the upper conveyance retarder may be a technogrid device.

The lower conveyance retarder may be an energy absorption device. The lower conveyance retarder may comprise one or more arms attached to the energy absorption device.

The lower conveyance retarder may be a technogrid device.

The technogrid device may comprise one or more technogrid elements and one or more technogrid arms, each arm being attached to a respective technogrid element.

Each technogrid arm may be moveable between a retracted condition in which the technogrid arm is held away from the path of the conveyance so as to be ineffective to retard movement of the conveyance, and an operative condition in which the technogrid arm is brought into proximity of the path of the conveyance so as to be effective to retard movement of the conveyance.

Each technogrid arm may be moveable to the operative condition by impact from the conveyance.

The conveyance may impact a trigger for triggering movement of each technogrid arm to the operative condition, once the conveyance has moved upwardly past the technogrid arm in an overwind event.

The energy absorption device may absorb kinetic energy of the conveyance through plastic deformation of the energy absorption device.

The energy absorption device may strain harden during plastic deformation, thereby to absorb the kinetic energy of the conveyance.

The technogrid of the lower conveyance retarder may be moved from its retracted condition to its operative condition by upward movement of the conveyance toward the upper crash barrier. More particularly, there may be a trip mechanism operatively connected to the technogrid and tripped by engagement with the conveyance to move the lower conveyance retarder to its operative condition.

The elongate hoisting element may be a wire rope or cable.

The present disclosure also extends to apparatus for removing excavated material from a mineshaft during formation of the shaft, comprising a material conveyance moveable up and down within the shaft to receive discrete loads of material excavated in the formation of the shaft and transport that material to a top of the mineshaft for discharge; and a hoist system as defined above and installed at the top of the mineshaft and operable to hoist said material conveyance.

The top of the mineshaft may be an earth surface region.

The present disclosure further extends to a safeguard against conveyance free fall in the event of a hoist rope failure resulting from an overwind condition, the safeguard being for use in a hoist system for hoisting a conveyance from a mineshaft, said safeguard including:

a conveyance catcher to prevent freefall downward movement of the conveyance along the mineshaft.

Some embodiments of the present system include an upper conveyance retarder to retard upward movement of the conveyance in case of an overwind event of said conveyance.

Some embodiments of the present system or apparatus include a lower conveyance retarder located below the upper conveyance retarder and the conveyance catcher to retard free fall of the conveyance in the event that the conveyance catcher fails to catch the free falling conveyance.

Some embodiments of the present system or apparatus include a lower crash barrier having an open condition in which to allow upward and downward movements of the conveyance from and into the mineshaft but releasable to a closed condition to prevent downward movement of the conveyance into the mineshaft in the event of a free fall of the conveyance.

Some embodiments of the present system or apparatus include an upper crash barrier for preventing upward movement of said conveyance beyond said upper crash barrier, said upper crash barrier to be located on a headframe of said hoist system.

The present disclosure also extends to a safeguard against debris free fall, in the event of a overwind condition, for use in a hoist system for hoisting a conveyance from a mineshaft, said safeguard including:

a lower crash barrier having an open condition in which to allow upward and downward movements of a conveyance from and into the mineshaft, and a closed condition to prevent debris from falling into the mineshaft.

When used in the context of describing the present system or apparatus, the term "free fall" may be taken to mean uncontrolled descent of the conveyance in a region above the shaft.

The term "free fall" as used in connection with the present invention relates to free fall as a result of an overwind event followed by rope failure.

In the design of a "guide" as used in conjunction with the present disclosure, it may be considered that a guide is to be sufficiently strong and rigid to resist any lateral and rotational forces resulting from impact loads and rotational forces of a fully loaded conveyance traveling up or down the shaft at maximum design speed of the conveyance. This will ensure the conveyance maintains safe clearance from any obstruction or other conveyances it may travel past over the length of the guide system.

There will, in general, be some 'tolerance' in the permissible degree of rotation or lateral movement that depends on clearances between, for example:

other conveyances concurrently running along the shaft.

the conveyance and the closest fixed object (obstruction) in the shaft—such a fixed object may be, for example, a pipe or shaft set.

the conveyance and opening at various points in the work stage through which the conveyance passes during upward or downward travel.

Guide systems may be designed and maintained to very tight tolerances, such as +/−4 mm in both directions (i.e. in plan view +/−4 mm North/South AND +/−4 mm East/West) for high speed conveyances over the length of a mineshaft.

Design tolerances may need to be tighter than the permissible maximum tolerance, to accommodate errors in installation (alignment), and wear of components (guides or conveyance bushings).

Tolerances may be tighter in areas where obstructions are present, such as in the work stage, and may be looser in areas where fewer or no obstructions are present, such as in the open shaft between the work stage and shaft-forming apparatus.

BRIEF DESCRIPTION OF THE DRAWINGS

In order that the invention may be more fully explained one particular embodiment will be described in detail by way of non-limiting example only, with reference to the accompanying drawings in which.

DETAILED DESCRIPTION OF THE PREFERRED EMBODIMENT

Figure 1:
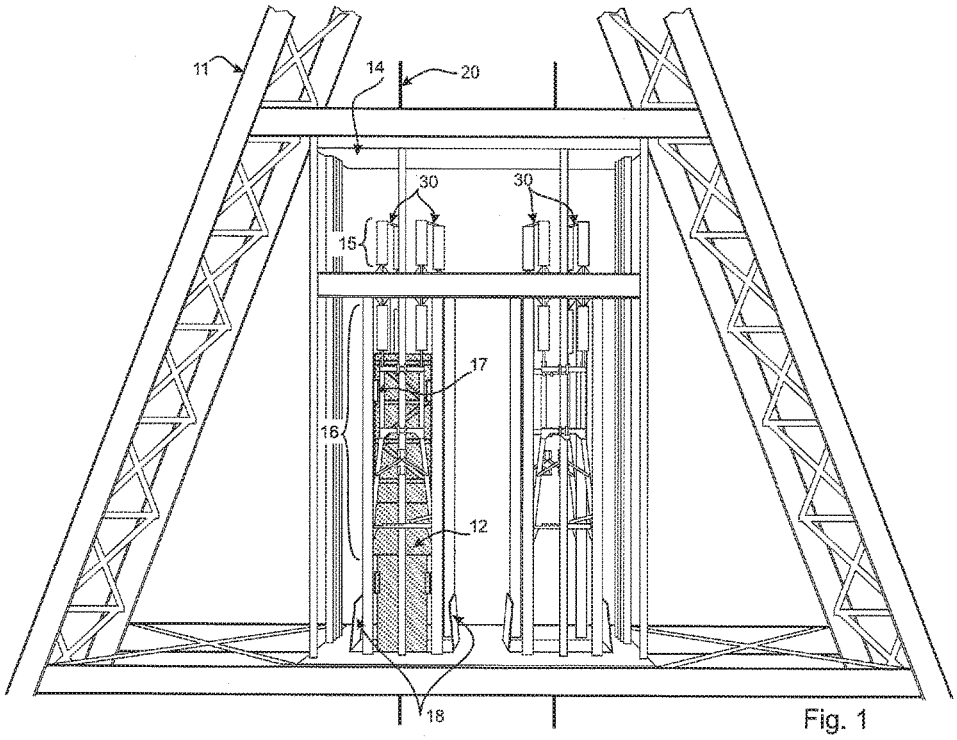
FIGS. 1 to 4 illustrates a hoisting system constructed in accordance with the invention at various stages of operation during an overwind event; inset

The drawings show part of a mineshaft head frame 11 fitted with a hoisting system for raising and lowering a pair of conveyances, each presently embodied by a 'skip' 12, along parallel vertical paths from and into a mineshaft. While the illustrated embodiment shows the use of two such conveyances or skips 12, it will be appreciated that 1, 3 or any other number of conveyances or skips may be used as appropriate.

The skips 12 are operated in tandem so that as one skip 12 is raised to the top of the mineshaft to discharge excavated material the other is lowered to the bottom of the mineshaft to be filled with further excavated material. The head frame carries one set of protection devices per skip 12, each set of protection devices being effective to arrest a respective skip 12 following an overwind event and subsequent hoist rope failure. The operation of the arresting system appearing at the left hand side of the drawings will be described but it is appreciated that a duplicate system is provided for the skip at the other side of the drawings.

Each skip 12 is raised and lowered by winding a rope 20 about a hoist drum (not shown). In general, the skips 12 will travel upwardly from a work stage to the top of the mineshaft. In this circumstance, each skip 12 may run along guides that ensure correct orientation of the skip 12 during filling and discharge of material. A hoist motor (not shown) moves the hoist rope, thereby providing the motive force to raise/lower each skip 12, whereas the guides serve only to prevent rotation and lateral swinging of the skip 12 during hoisting. The guides may include a variable length guide (e.g. stage ropes) extending down to the work stage. The variable length guide may extend into the head frame 11. Alternatively, fixed guides may be provided in the head frame 11 as shown, with each skip 12 transitioning onto the fixed guides during upward travel.

Guides and guide systems are discussed in Australian patent application No. 2013903212, entitled "Skip and Crosshead" and filed on 23 Aug. 2013), the entire content of which is incorporated herein by reference.

In normal operation the skip 12 is brought to rest at a discharge position within the head frame 11 and its contents are discharged before the skip 12 is lowered back into the mineshaft. The contents of the skip 12 may be discharged or otherwise deposited on the ground, onto a conveyor or in a bin or other receptacle, as necessary for storage or conveyance of the mined material after extraction of that material from the mineshaft.

In an overwind event the skip 12 is hoisted above its normal discharge position until it hits an upper crash barrier in the form of a horizontal crash beam 14 fixed to the head frame 11. A conveyance arrest system then prevents free fall of the skip 12 back down the mineshaft. The conveyance arrest system comprises upper and lower conveyance retarders 15, 16, a conveyance catcher 17 and a lower crash barrier 18.

The upper and lower conveyance retarders 15, 16 may include technogrids of the kind marketed by the Horne Group and affiliated companies in South Africa, United States and Canada. Each technogrid is a deformable steel grid section. On impact the individual elements of the grid are deformed in controlled bending which converts the kinetic energy into strain energy that is safely dissipated in the form of low grade heat.

The upper conveyance retarder 15 is fixed in position so as to retard upward movement of the skip as it approaches the upper crash barrier 14.

Figure 9:
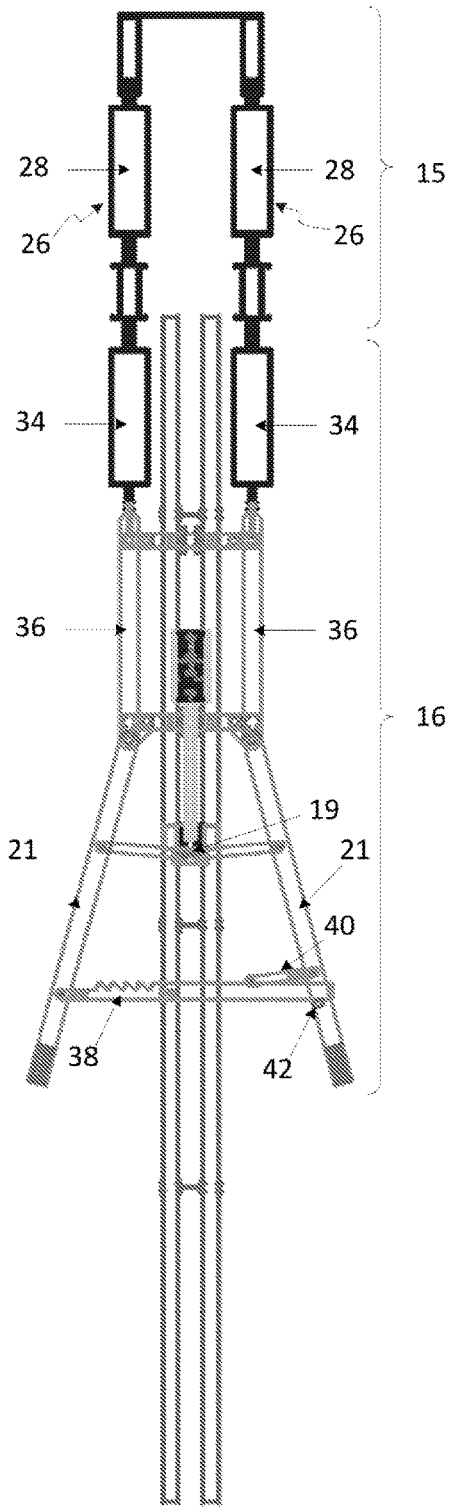
FIG. 9 is a close up view of the upper and lower conveyance retarders.

The upper conveyance retarder 15, as shown in FIG. 9, is in the form of a pair of technogrid assemblies 26.

There are two technogrid assemblies 26 for each conveyance.

The technogrid assemblies each comprise a pair of technogrids 28.

Figure 2A:
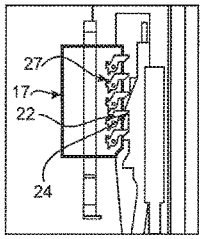
FIGS. 2A and 2B show magnified details of the conveyance catcher and conveyance retarders, respectively, of FIG. 2; inset
Figure 2B:
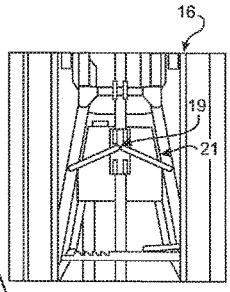
Figure 2:
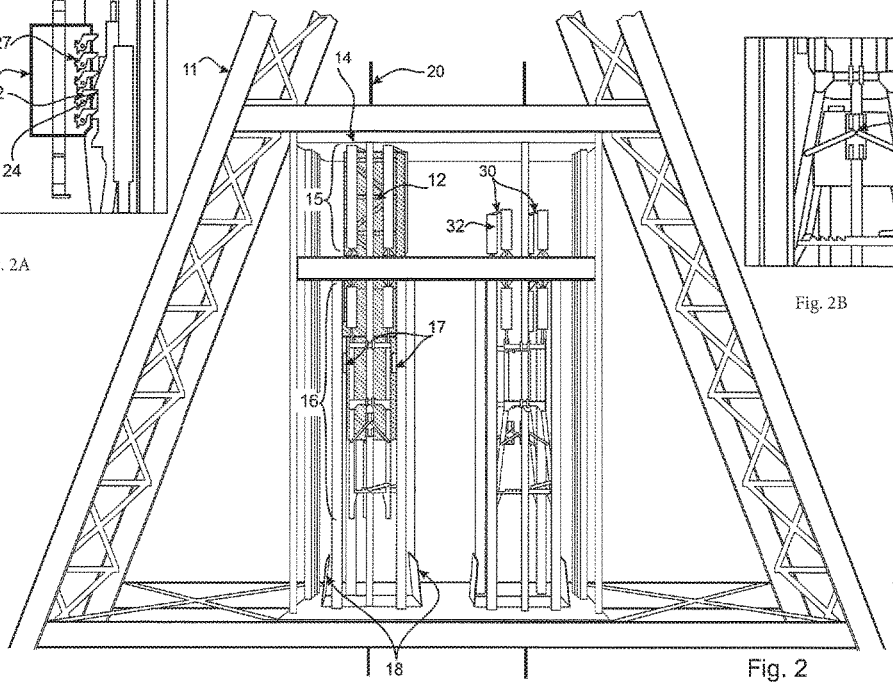

The technogrids 28 of each assembly 26 are connected to each other at the top by a lateral connector 30, so as to form a substantially U-shaped body 32 as shown in FIG. 2.

Figure 11:
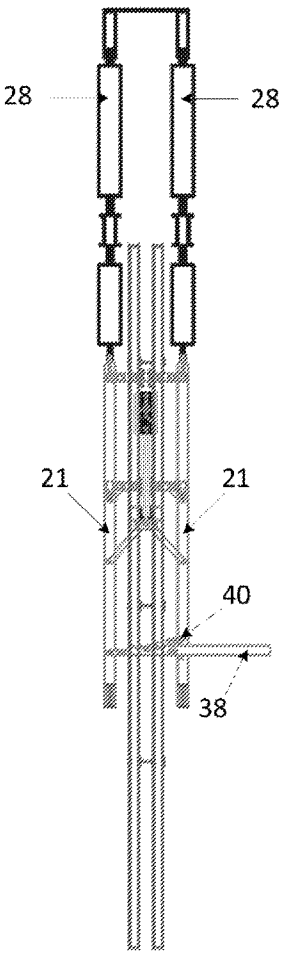
Figure 10:
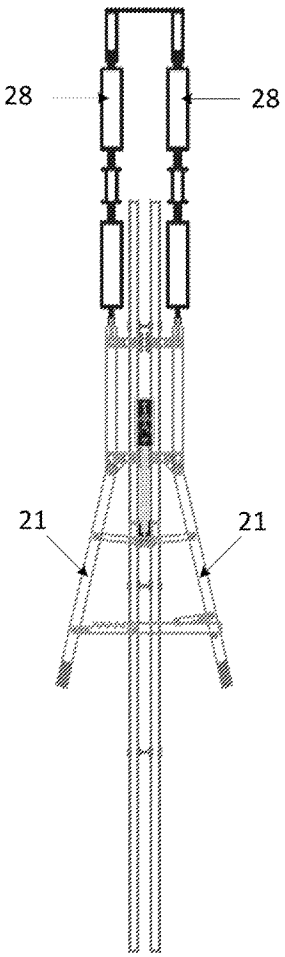

When operating normally, the technogrids 28 are as shown in FIG. 10. When a skip 12 enters an overwind condition and continues to travel upwardly, the skip 12 travels between the technogrids 28 of the U-shaped bodies 32, and impacts the lateral connectors 30. The respective technogrids 28 then plastically deform—elongating under strain—as shown in FIG. 11. This plastic deformation absorb kinetic energy from the skip 12, thereby slowing the skip 12. If the upper conveyance retarder 15 fails to absorb all of the kinetic energy of the skip 12, and the skip 12 continues upward, then the skip 12 will impact the upper crash beam 14. At this point, upward movement of the skip 12 will cease.

Once the skip 12 has ceased travelling upward, it will descend under gravity. The first safety system used to stop the conveyance during descent is the conveyance catcher 17.

Figures 3, 3A, 3B:
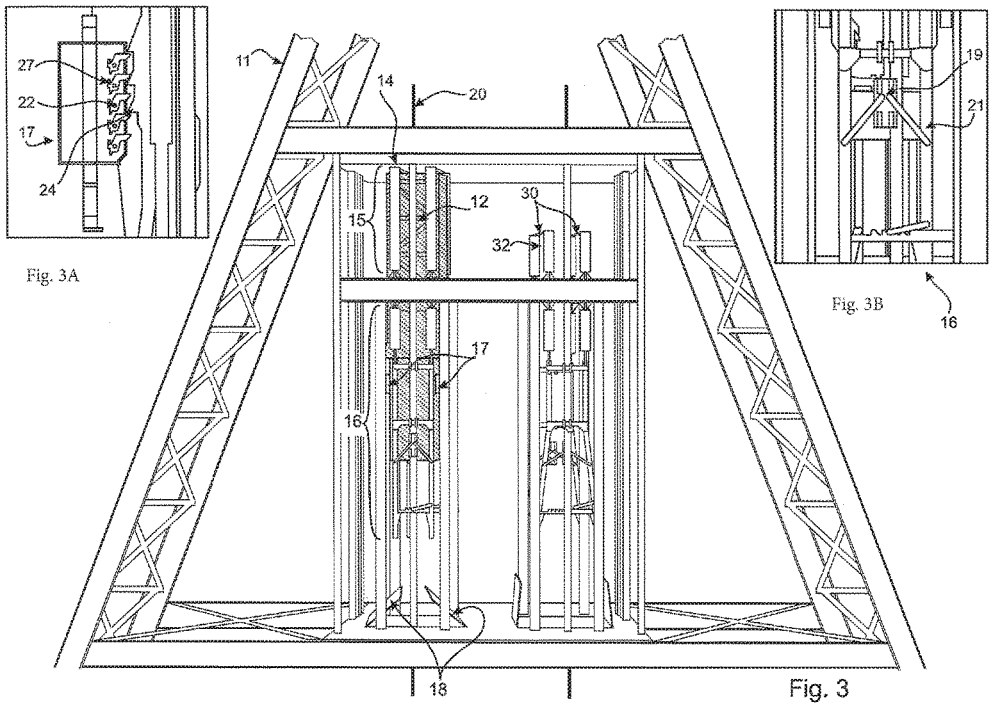
FIGS. 3A and 3B show magnified details of the conveyance catcher and conveyance retarders, respectively, of FIG. 3.
Figure 8:
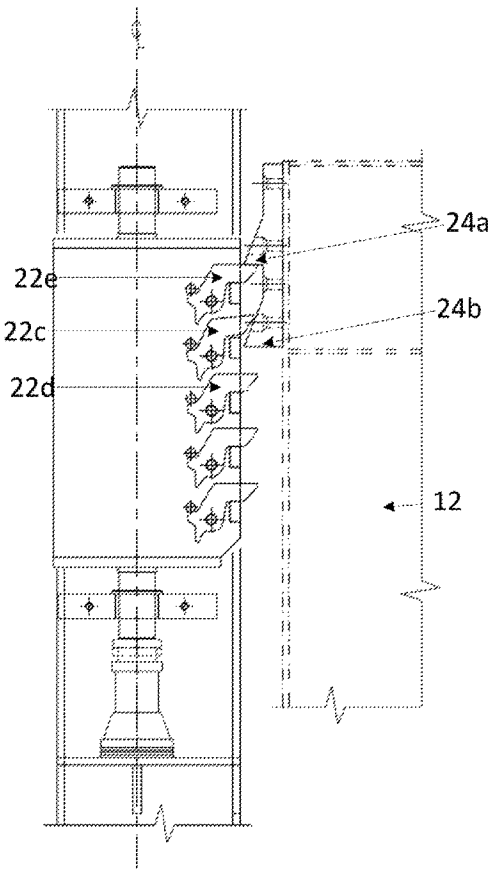
FIGS. 6 to 8 show progressive stages of the conveyance being engaged by the conveyance catcher.

Attention is drawn to FIGS. 2A and 3A. Conveyance catcher 17 is in the form of one or more jack catchers each comprising a vertical column of pivoting catchers 22 fixed to the head frame 11 and a co-operating set of projecting lugs or teeth 24 mounted on the skip 12 at any appropriate position, including the skip body. The jack catchers 22 have an extended, normal condition as shown by jack catcher 22*a* in FIG. 5, and a retracted condition as shown by jack catcher 22*b*. The jack catchers 22 remain in the extended condition under gravity. In this condition, the jack catchers 22 bear against respective retaining lugs 27 that prevent the jack catchers 22 from rotation past the extended condition as shown. The jack catchers 22 pivot upwards from the extended condition and into the retracted condition when impacted by the projecting lugs 24 of the skip 12, permitting upward movement of the skip 12 past the jack catchers 22. The jack catchers 22 then drop back to the extended condition, behind the projecting lugs 24, under gravity. When the skip 12 attempts to fall downwardly, the jack catchers 22 catch the teeth or projections 24 on the skip 12 as shown in FIG. 8, to arrest movement of the skip 12. Preferably there are at least two vertical columns of jack catchers 22. The columns in the present example are disposed on opposite sides of the skip 12.

Figure 7:
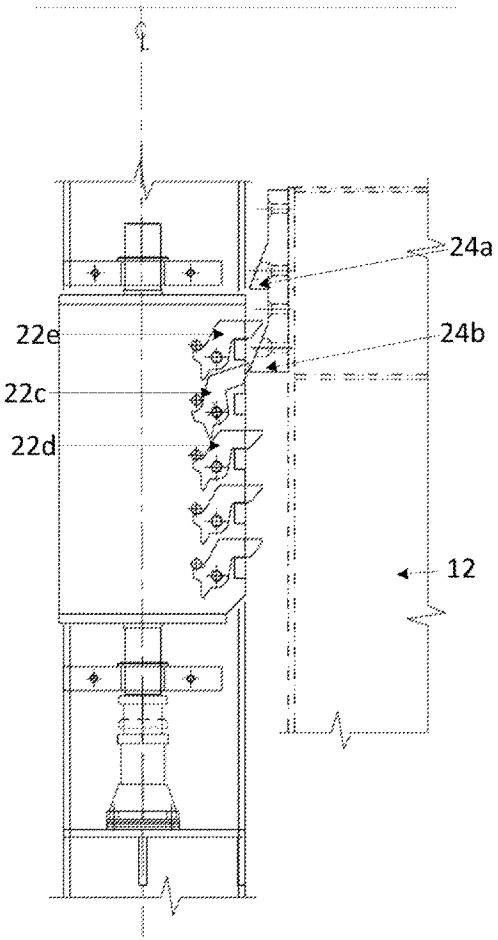
Figure 6:
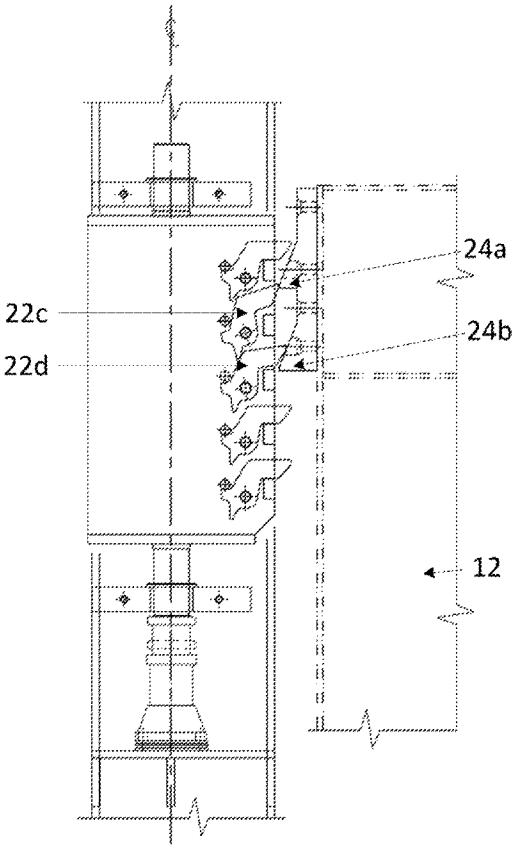

The process of a skip 12 moving past the jack catchers 22, and coming to rest against the column of jack catchers 22 is shown sequence in FIGS. 6 to 8. In FIG. 6, the projecting lugs 24*a*, 24*b* of the skip 12 impact against jack catchers 22*c*, 22*d*. This impact pivots jack catchers 22*c*, 22*d* into the retracted condition.

FIG. 7 shows the skip 12 once it has stopped its upward movement during an overwind condition. The top projecting lug 24*a* has moved past the uppermost jack catcher 22*e*.

In FIG. 8, the skip 12 has descended until projecting lug 24*a* bears against jack catcher 22*e*, thereby halting movement of the skip 12. If the skip 12 impacts the jack catchers 22 with sufficient force, the jack catchers 22 will break and thus the lower technogrids and crash doors (discussed below) will attempt to stop downward movement of the skip 12.

Notably, for traditional blasting and mucking operations, a bucket or kibble is used. As discussed above, the bucket or kibble is round so that its ability to be loaded and dumped is unaffected by rotation of the bucket or kibble. Since the bucket or kibble may have rotated before entering the head frame, the precise orientation of the bucket or kibble is unknown.

Accordingly, teeth or projections, such as those provided on the skip 12 of the present disclosure, would not be provided on the bucket or kibble since it is uncertain whether those teeth or projections will align with the jack catchers.

The conveyance catcher 17 of the present disclosure prevents freefall downward movement of the skip 12 along the mineshaft, in the event that the hoist rope fails as the result of an overwind condition. The conveyance catcher 17 therefore acts as part of a safeguard against conveyance freefall, constituting part of a hoist system for hoisting a conveyance from a mineshaft.

Such a safeguard could include an upper conveyance retarder 15 that retards upward movement of the conveyance 12 in case of an overwind event of said conveyance 12 (discussed further below), and/or a lower conveyance retarder 16 located below the upper conveyance retarder 15 and the conveyance catcher 17 to retard freefall of the skip 12 in the event that the conveyance catcher 17 fails (discussed further below).

The lower conveyance retarder 16 has technogrid elements 34 and technogrid arms 21 attached to each technogrid element 34 through a linkage 36. Each technogrid arm 21 is generally in an open condition. This condition is shown in FIGS. 9 and 10 in which the technogrid arm 21 is held out of the path of skip 12 so as to allow upward movement of the skip 12 toward the upper crash barrier 14.

Attention is drawn to FIGS. 2B and 3B. During upward movement of the skip 12 in an overwind condition, the skip 12 engages a trip mechanism 19. The trip mechanism 19 is in the form of a pair of pivotally connected bars that extend to respective ones of the technogrid arms 21. They trip mechanism 19 may be engaged by a hook or other mechanism, mounted on the skip 12. Activation of the trip mechanism 19 causes the technogrid arms 21 to move to a closed condition as shown in FIG. 11. In the closed condition the technogrid arms 21 are positioned beneath the skip 12 such that they will engage the skip 12 upon descent, and the technogrid elements will retard subsequent downward movement of the skip 12.

A ratchet bar 38 is connected to one of the technogrid arms 21, and a bolt 40 is connected to the other of the technogrid arms 21. The ratchet bar 38 and bolt 40 engage to hold the technogrid arms 21 together.

As the arms 21 come together, the bar 38 of one arm 21 rides along a lug 42 on the other arm 21. Once the arms 21 are sufficiently close, the bolt 40 will fall into the teeth of the ratchet bar 38. An angled rear surface of each tooth enables the bolt 40 to continue to slide over the teeth to allow the arms 21 to approach, but the curved front face of each tooth engages the bolt 40 to prevent the arms 21 from subsequently moving apart.

Figure 12:
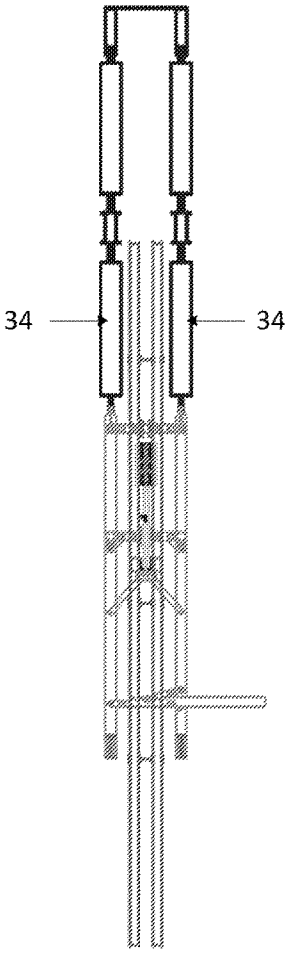
FIGS. 10 to 12 show progressive stages of the conveyance being engaged by the conveyance retarders.

FIGS. 10 to 12 show progressive stages in the engagement of the lower conveyance retarder 16. FIG. 10 shows the arms 21 of the lower conveyance retarder 16 in an open condition, permitting upward passage of the skip 12 therebetween. FIG. 11 shows the upper conveyance retarder 15 having been engaged and plastically extended, the arms 21 closed beneath the skip 12, and the ratchet 38 and bolt 40 engaged to prevent the arms 21 from reopening. FIG. 12 shows the lower conveyance retarder 16 after engagement by the skip 12, with the technogrid elements 34 plastically extended to absorb kinetic energy of the falling skip 12.

The technogrid elements 34 plastically deform and strain harden to absorb the kinetic energy of the descending skip 12, and to transfer energy form the skip 12 to the head frame 11.

The lower crash barrier 18 is in the form of a crash door having an upwardly hinged retracted position to allow free passage of the conveyance into and out of the mineshaft. In an overwind condition, the conveyance travels toward the upper crash barrier, triggering the lower crash barrier door to drop to a closed position to prevent free fall of the skip and/or debris back into the mineshaft.

The lower crash barrier 18 is spring loaded so that spring force initiates closure of the lower crash barrier 18, after which gravity takes over and completes closure of the lower crash barrier 18.

It will be appreciated that when the system acts as a safeguard against skip 12 freefall, the means for retarding that freefall (namely retarders 15 to 18) may be individually selected according to the particular requirements of a mining project, and the mass of the conveyance 12 when loaded.

A loaded conveyance (i.e. skip 12) may have a total weight of 6 or 8 t for smaller systems or, for larger systems, a total weight in the order of 20 tonnes or more. If the conveyance were to experience an overwind event and consequently descend in freefall back towards the mineshaft, the lower crash barrier 18 would need to have sufficient strength to withstand the force of the fully loaded conveyance moving at potentially high speed. The lower crash barriers 18 would therefore need to be very heavy, and heavy duty.

In the present case, the rate of descent of the conveyance can advantageously be considerably reduced by the conveyance catcher 17 and conveyance retarders 15, 16. Consequently, the lower crash barrier 18 need only be as strong as necessary to stop a fully loaded conveyance moving at a reduced speed (i.e. with reduced kinetic energy) when compared with the case where no conveyance catcher 17 or conveyance retarders 15, 16 are provided. In other words, it may be possible to design the lower crash barrier 18 to have a strength less than would be required to completely arrest movement of a conveyance that has traveled in freefall from immediately after an overwind event.

Figure 5:
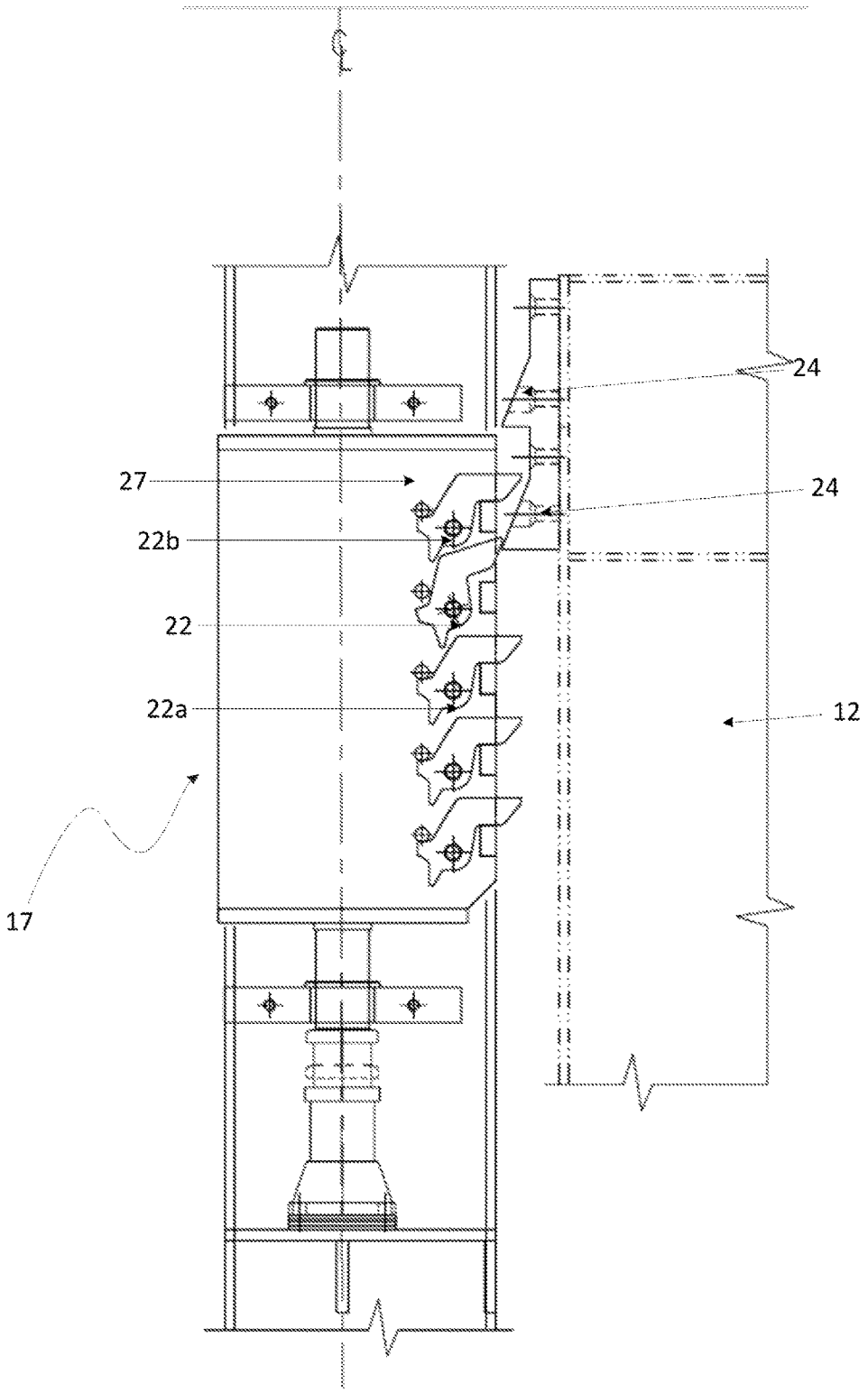
FIG. 5 is a close up view of the conveyance catcher (jack catchers) and conveyance (skip)

Operation of the illustrated hoist system is indicated diagrammatically at FIG. 5. On the occurrence of an overwind event the skip 12 is hoisted upwardly toward the upper crash barrier 14. As the skip approaches the crash barrier (see FIG. 1) the upper conveyance retarder 15 is impacted to retard and slow the skip so as to reduce rebound energy. As the skip approaches the crash barrier (see FIG. 2) and is slowed by the upper technogrid the lower technogrid trip mechanism is tripped by the upward movement of the skip to cause the lower technogrid arms 21 to be brought inwardly into an operative position beneath the skip 12, and the final upward movement of the skip 12 also triggers release of the lower crash barrier 18 so that it moves to the closed condition.

The system and safeguard of the present disclosure advantageously allow the presence of workers under the suspended load of the conveyance, for example within the mineshaft, thereby increasing the safety and efficiency of the shaft sinking process.

Figure 4:
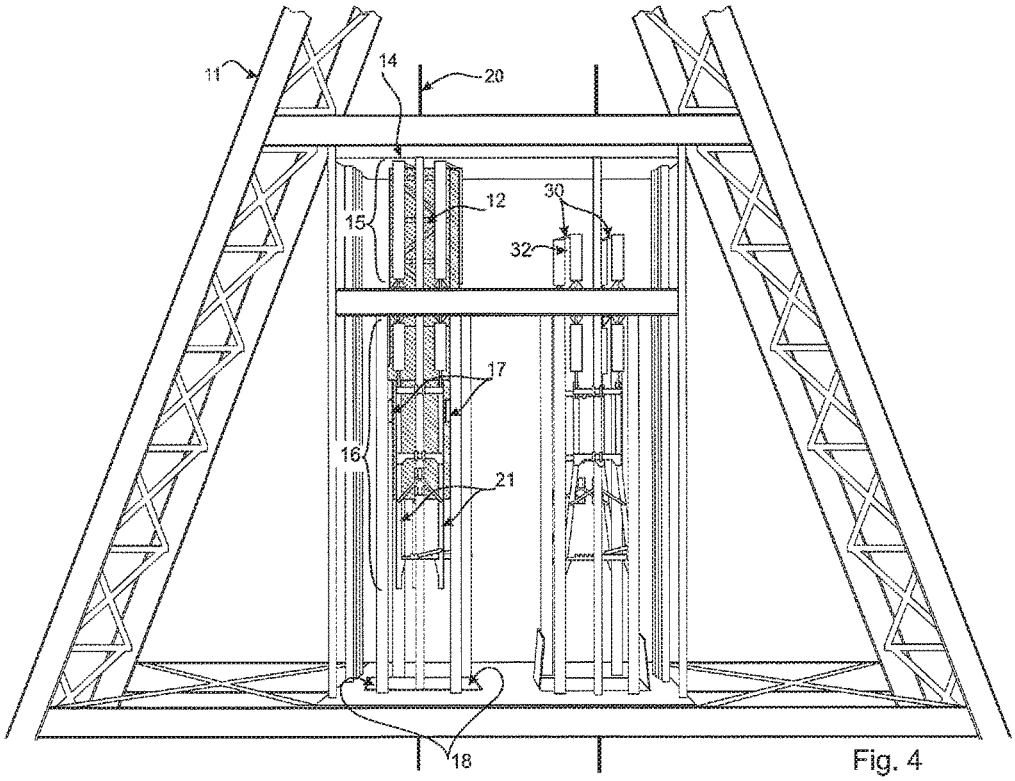
Figure 13:
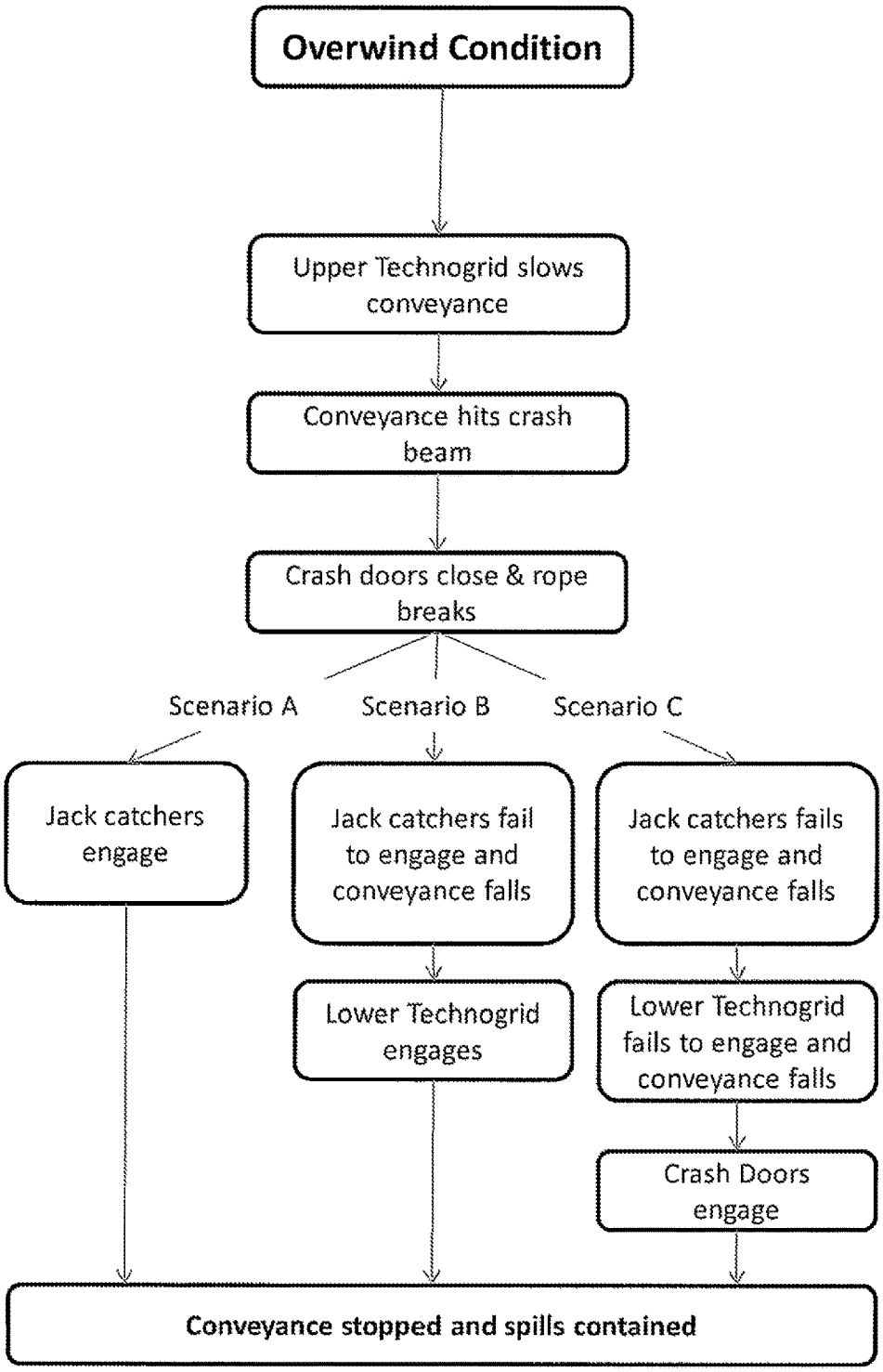
FIG. 13 shows diagrammatically the sequence of operations during overwinding events.

If an overwind event is experienced during upward movement of the skip 12, the skip 12 will impact the upper barrier 14. If that impact is sufficient to cause the hoist rope 20 to fail, the skip will begin to fall downwardly. It is then anticipated (FIG. 3 and scenario A in FIG. 13) that the jack catchers of the conveyance catcher 17 will engage to stop the skip 12. In the event that the jack catchers fail to engage successfully to stop the skip (FIG. 4 and scenario B in FIG. 13) the skip falls so as to impact the technogrid arms 21 of the lower conveyance retarder 16 that then engage to stop the skip 12. In the event that the lower conveyance retarder fails to arrest the skip 12 (scenario C in FIG. 13), the skip 12 impacts the crash door of the lower crash barrier 18 so as to be stopped from falling into the mineshaft. In all three scenarios the crash door of the lower crash barrier 18, having closed prior to downward movement of the skip, is effective to contain any spills and debris from the skip during rebound and falling movement.

The invention claimed is:

1. A hoist system for hoisting a conveyance from a mineshaft, wherein the conveyance is a skip, the system comprising:

a head frame mounted over the mineshaft;

a hoist connected to the conveyance by an elongate flexible hoisting element so as to be operable to hoist the conveyance from the mineshaft by winding the hoisting element;

an upper crash barrier located on the head frame so as to be engageable by the conveyance to prevent upward movement of the conveyance beyond the crash barrier in an overwind condition; and an upper conveyance retarder capable of retarding upward movement of the conveyance, by undergoing plastic deformation, as the conveyance approaches the crash barrier.

2. The hoist system as claimed in claim 1, further comprising a conveyance catcher to catch the conveyance from free fall downward movement if the conveyance engages the upper crash barrier and the hoisting element fails.

3. The hoist system as claimed in claim 2, further comprising a lower conveyance retarder located below the upper conveyance retarder and the conveyance catcher, the lower conveyance retarder for retarding free fall of the conveyance in the event that the conveyance catcher fails to catch the free falling conveyance.

4. The hoist system as claimed in claim 3, further comprising a lower crash barrier having an open condition in which to allow upward and downward movements of the conveyance from and into the mineshaft, and a closed condition to prevent debris from falling into the mineshaft.

5. The hoist system as claimed in claim 4, wherein upward movement of the conveyance triggers release of the lower crash barrier to move to its closed condition.

6. The hoist system as claimed in claim 5, wherein upward movement of the conveyance triggers release of the lower crash barrier prior to engagement of the conveyance with the upper crash barrier.

7. The hoist system as claimed in claim 2, wherein the conveyance catcher is a jack catcher.

8. The hoist system as claimed in 7, wherein the jack catcher comprises pivoting jack catches on the headframe engageable with lugs on the conveyance to catch the conveyance against downward movement.

9. The hoist system of claim 3 comprising a lower crash barrier having an open condition in which to allow upward and downward movements of the conveyance from and into the mineshaft but releasable upon upward movement of the conveyance toward or into engagement with the upper crash barrier to a closed condition to prevent downward movement of the conveyance into the mineshaft if the lower conveyance retarder fails to stop a free fall of the conveyance.

10. The hoist system as claimed in claim 3, wherein the upper conveyance retainer and the lower conveyance retarders are energy absorption devices.

11. The hoist system as claimed in claim 3, wherein the lower conveyance retarder is an energy absorption device.

12. The hoist system as claimed in claim 3, wherein the lower conveyance retarder is capable of retarding free fall of the conveyance by undergoing plastic deformation.

13. The hoist system of claim 4 wherein the conveyance catcher is arranged to catch the conveyance from free fall downward movement if the conveyance engages the upper crash barrier and the hoisting element fails.

14. The hoist system as claimed in claim 5, wherein when activation of the upper conveyance retarder is active to retard upward movement of the conveyance, release of the lower crash barrier is triggered.

15. The hoist system of claim 1 comprising:

a conveyance catcher to catch the conveyance from free fall downward movement in the event that the conveyance engages the upper crash barrier and the hoisting element fails;

a lower conveyance retarder located below the upper conveyance retarder and the conveyance catcher, the lower conveyance retarder for retarding free fall of the conveyance in the event that the conveyance catcher fails to catch the free falling conveyance; and a lower crash barrier having an open condition in which to allow upward and downward movements of the conveyance from and into the mineshaft but releasable upon upward movement of the conveyance toward or into engagement with the upper crash barrier to a closed condition to prevent downward movement of the conveyance into the mineshaft in the event that the lower conveyance retarder fails to stop a free fall of the conveyance.

16. The hoist system as claimed in claim 15, wherein the conveyance catcher is a jack catcher.

17. The hoist system as claimed in claim 15, wherein one or both of the upper conveyance retarder and the lower conveyance retarder is an energy absorption device.

18. Apparatus for removing excavated material from a mineshaft during formation of the mineshaft, comprising:

a material conveyance moveable up and down within the mineshaft intermittently to receive discrete loads of material excavated during formation of the mineshaft and transport that material to the top of a mineshaft for discharge, wherein the conveyance is a skip; and a hoist system as claimed claim 1 installed at the top of the mineshaft and operable to hoist said material conveyance.

19. Apparatus for removing excavated material from a mineshaft during formation of the mineshaft, comprising:

a material conveyance moveable up and down within the shaft intermittently to receive discrete loads of material excavated in the formation of the shaft and transport that material to a top of a mineshaft for discharge, the material conveyance being a skip; and a hoist system installed at the top of the mineshaft and operable to hoist said material conveyance, the hoist system comprising:

a head frame mounted over the mineshaft;

a hoist connected to the conveyance by an elongate flexible hoisting element so as to be operable to hoist the conveyance from the mineshaft by winding the hoisting element;

an upper crash barrier located on the head frame so as to be engageable by the conveyance to prevent upward movement of the conveyance beyond the crash barrier in an overwind condition; and an upper conveyance retarder capable of retarding upward movement of the conveyance, by undergoing plastic deformation, as the conveyance approaches the crash barrier.

20. A hoist system for hoisting a conveyance from a mineshaft, the conveyance being a skip, the hoist system comprising:

a head frame mounted over the mineshaft;

a hoist connected to the conveyance by an elongate flexible hoisting element so as to be operable to hoist the conveyance from the mineshaft by winding the hoisting element;

an upper crash barrier located on the head frame so as to be engageable by the conveyance to prevent upward movement of the conveyance beyond the crash barrier in an overwind condition;

an upper conveyance retarder capable of retarding upward movement of the conveyance, by undergoing plastic deformation, as the conveyance approaches the crash barrier; and a lower crash barrier having an open condition in which to allow upward and downward movements of the conveyance from and into the mineshaft, and a closed condition to prevent debris from falling into the mineshaft;

wherein upward movement of the conveyance triggers release of the lower crash barrier to move to its closed condition.

* * * * *